US005610003A

United States Patent [19]

Lussier

[11] Patent Number: 5,610,003

[45] Date of Patent: Mar. 11, 1997

[54] TWO-EQUIVALENT MAGENTA PHOTOGRAPHIC COUPLERS WITH ACTIVITY-MODIFYING BALLASTING GROUPS

[75] Inventor: Barbara B. Lussier, Rochester, N.Y.

[73] Assignee: Eastman Kodak Company, Rochester, N.Y.

[21] Appl. No.: 500,818

[22] Filed: Jul. 10, 1995

Related U.S. Application Data

[63] Continuation of Ser. No. 264,402, Jun. 23, 1994, abandoned.

[51] Int. Cl.[6] ..... G03C 1/08; G03C 7/26; G03C 7/32

[52] U.S. Cl. ..... 430/555; 430/543; 430/387

[58] Field of Search ..... 430/543, 555, 430/387

[56] References Cited

U.S. PATENT DOCUMENTS

| | | | |
|---|---|---|---|
| 4,076,533 | 2/1978 | Ota et al. | 430/554 |
| 4,241,168 | 12/1980 | Arai et al. | 430/503 |
| 4,262,087 | 4/1981 | Quaglia | 430/503 |
| 4,310,619 | 1/1982 | Ichijima et al. | 430/397 |
| 4,366,237 | 12/1982 | Ichijima et al. | 430/505 |
| 4,840,877 | 6/1989 | Abe et al. | 430/555 |
| 4,914,013 | 4/1990 | Ikesu et al. | 430/555 |
| 5,256,528 | 10/1993 | Merkel et al. | 430/550 |
| 5,262,292 | 11/1993 | Krishnamurthy et al. | 430/555 |
| 5,350,667 | 9/1994 | Singer et al. | 430/555 |

*Primary Examiner*—Geraldine Letscher
*Attorney, Agent, or Firm*—Alfred P. Lorenzo

[57] ABSTRACT

An improved photographic element comprises a support bearing at least one silver halide emulsion layer having associated therewith a two-equivalent 5-pyrazolone magenta-dye-forming coupler. The coupler has a coupling-off group in the 4-position and an activity-modifying ballasting group in the 3-position. The ballasting group includes a hydrogen-bonding substituent and provides a unique combination of steric, hydrophobic and conformational properties which allows the coupling activity to be controlled.

22 Claims, No Drawings

TWO-EQUIVALENT MAGENTA PHOTOGRAPHIC COUPLERS WITH ACTIVITY-MODIFYING BALLASTING GROUPS

This Continuation of U.S. application Ser. No. 08/264,402, filed 23 Jun. 1994, now abandoned.

FIELD OF THE INVENTION

This invention relates in general to photography and in particular to magenta-dye-forming couplers that are useful in photography. More specifically, this invention relates to novel two-equivalent 5-pyrazolone magenta-dye-forming couplers and to their use in silver halide photographic elements.

BACKGROUND OF THE INVENTION

Silver halide photographic elements utilizing four-equivalent 5-pyrazolone magenta-dye-forming couplers are well known. Processing of these materials requires a stabilization step, usually employing a formaldehyde reagent, in which unreacted coupler is converted to an inert form that cannot initiate magenta dye fade.

It is also well known to use two-equivalent 5-pyrazolone magenta-dye-forming couplers which are advantageous because of their increased efficiency. Moreover, the two-equivalent 5-pyrazolone magenta-dye-forming couplers do not require the stabilization step and thus are environmentally advantageous alternatives to the four-equivalent couplers. However, the known two-equivalent 5-pyrazolone magenta-dye-forming couplers are generally too active, giving densities and granularities that are unacceptably high for use in state-of-the-art reversal film systems. This is particularly true when using low pH developers, for example, developers with a pH of less than 11.7.

Two-equivalent 5-pyrazolone magenta-dye-forming couplers known to the art typically incorporate ballast moieties that are primarily designed to prevent diffusion through the layers of the photographic element in which they are incorporated. Examples of such two-equivalent 5-pyrazolone magenta-dye-forming couplers are those described in U.S. Pat. No. 4,076,533 in which the coupling-off group is a triazole, U.S. Pat. No. 4,241,168 in which the coupling-off group is a 5-membered heterocycle, and U.S. Pat. No. 4,310,619 in which the coupling-off group is a substituted pyrazole. In these couplers, the ballast moieties comprise derivatives of anilino, benzamido, alkyl, arylureido or acylamino groups. The result is coupling activities, densities and granularities that are undesirably high.

It is toward the objective of providing novel two-equivalent 5-pyrazolone magenta-dye-forming couplers comprising activity-modifying ballasting groups which render them useful in state-of-the-art reversal film systems that the present invention is directed.

SUMMARY OF THE INVENTION

This invention provides improved photographic elements comprising a support bearing at least one silver halide emulsion layer having associated therewith a two-equivalent 5-pyrazolone magenta-dye-forming coupler. The coupler has a coupling-off group in the 4-position and an activity-modifying ballasting group in the 3-position. The ballasting group:

(1) comprises an —NHCO— radical which is attached via the nitrogen atom thereof to the 3-position of the 5-pyrazolone ring, (2) has a ClogP value of at least 6, and (3) comprises a hydrogen-bonding substituent which (a) forms a five- or six-membered hydrogen-bonded ring with the —NHCO— radical and (b) contains a sterically hindering group with a negative Es value greater than the absolute value of −1.5.

Ballasting groups are typically incorporated into a coupler molecule to prevent interlayer diffusion and are not usually used to modify coupler activity. However, in accordance with this invention, it has been found that the ballast portion of two-equivalent 5-pyrazolone magenta-dye-forming couplers can be used to control the level of coupling activity. This is accomplished by use of a ballasting group which is highly hydrophobic and is structured to create a sterically hindering environment during the formation of the tetrahedral leuco dye intermediate. The highly hydrophobic properties of the ballasting group cause the coupler to partition into the high boiling organic "coupler solvent" in which it is dissolved and coated. This renders the coupler less accessible to oxidized developer and slows down the coupling rate. The ballasting group also creates steric hindrance to leuco dye formation by means of a geometric conformation that crowds the transition state and reduces the quantity of leuco dye formed. That which is formed is completely converted to magenta dye during normal processing. Rigidity of the desired conformation is achieved by incorporation in the coupler molecule of hydrogen bonding functionalities. This combination of structural features serves to lower the activity of the two-equivalent 5-pyrazolone magenta-dye-forming coupler to give appropriate dye density and improved granularity in reversal film systems.

DESCRIPTION OF THE PREFERRED EMBODIMENTS

The novel two-equivalent 5-pyrazolone magenta-dye-forming couplers of this invention have a unique combination of steric, hydrophobic and conformational properties which function conjointly to effectively control coupling activity.

Among the many advantages of the novel couplers of this invention are (1) appropriate coupling activity levels (i.e., dye density) and a method for manipulation and control of this activity, (2) improved granularity and (3) no need for addition of excess free ballast acid (see U.S. Pat. 4,840,877) to prevent stable leuco formation and/or silver desensitization.

Any two-equivalent 5-pyrazolone magenta-dye-forming coupler in which the ballasting group meets the criteria set forth hereinabove is within the scope of the present invention. Representative of such two-equivalent 5-pyrazolone magenta-dye-forming couplers are those of the formula:

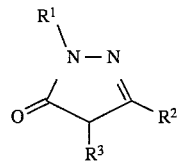

wherein $R^1$ is hydrogen or a monovalent organic radical;

$R^3$ is a coupling-off group; and $R^2$ is an activity-modifying ballasting group of the formula:

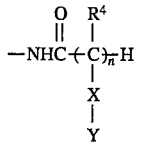

wherein n is 1 or 2, $R^4$ is a monovalent organic group with a $\pi$ value of at least 2.1, X is a heteroatom that can hydrogen bond to the hydrogen atom of the —NHCO— radical, and Y is a monovalent organic group which sterically hinders leuco dye formation.

As indicated hereinabove, $R^1$ is hydrogen or a monovalent organic radical. Examples of suitable monovalent organic radicals include those selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxy carbonyl, ureido, nitro, alkyl and trifluoromethyl groups. Preferably $R^1$ is a chlorine substituted phenyl group such as monochlorophenyl, 2,6-dichlorophenyl, 2,4,6-trichlorophenyl, tetrachlorophenyl or pentachlorophenyl. Most preferably, $R^1$ is 2,4,6-tri-chlorophenyl.

As hereinabove described, $R^3$ is a coupling-off group. Examples of suitable coupling-off groups include halogens, alkoxy groups, aryloxy groups, alkylthio groups, arylthio groups, acyloxy groups, sulfonamido groups, carbonamido groups, arylazo groups, nitrogen-containing heterocyclic groups such as triazole, benzotriazole, pyrazolyl and imidazolyl, substituted nitrogen-containing heterocyclic groups, and imido groups such as succinimido and hydantoinyl groups. In the magenta-dye-forming couplers of this invention, it is preferred that the coupling-off group is a pyrazolyl group. Coupling-off groups are described in further detail in U.S. Pat. Nos. 2,355,169, 3,227,551, 3,432,521, 3,476,563, 3,617,291, 3,880,661, 4,052,212 and 4,134,766, the disclosures of which are incorporated herein by reference.

$R^4$ is a monovalent organic group with a $\pi$ value of at least 2.1. As used herein, the $\pi$ value is determined by the equation:

$$\pi_X = \log P_X - \log P_H$$

where $P_x$ is the partition coefficient of a derivative and $P_H$ is the partition coefficient of the parent compound. A detailed description of the determination of the $\pi$ value is provided by A. Leo, C. Hansch and D. Elkins, *Chem. Rev.*, 71, 525 (1971).

The $R^4$ group determines the hydrophobic properties of the coupler. Preferred $R^4$ groups are alkyl groups of at least four carbon atoms represented by the formula $C_mH_{2m+1}$ where m is an integer with a value of from 4 to 20. Aryl and substituted aryl groups are also particularly useful as the $R^4$ group.

X is a heteroatom that can hydrogen bond to the hydrogen atom of the -NHCO- radical. Examples of suitable heteroatoms include oxygen, nitrogen and sulfur.

Y is a monovalent organic group which sterically hinders leuco dye formation. The sterically hindering group is characterizedby a negative Es value greater than the absolute value of −1.5 and more preferably greater than the absolute value of −2.0. The Es value refers to the Taft steric parameter, referenced to H=O and defined as:

$$Es = \log(k_x/k_H)_A - 1.24$$

where k refers to the rate constant for the acid hydrolysis of esters of the type X—$CH_2$COOR and 1.24 is the hydrolysis rate of formate. A detailed description of this parameter is provided by S. H. Unger and C. Hansch, *Prog. Phys. Org. Chem.*, 12, 91 (1976).

In the couplers of this invention, Y can be an alkyl group, an aryl group or a heterocyclic group or a substituted derivative of an alkyl group, an aryl group or a heterocyclic group. Preferably Y is a branched alkyl group or an aryl ring substituted with a branched alkyl group. Examples of such branched alkyl groups include isopropyl, sec-butyl, tert-butyl, tert-pentyl, neopentyl, tert-octyl and the like.

In one preferred embodiment of the invention, $R^2$ represents a ballasting group of the formula:

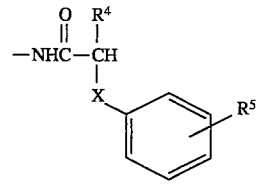

wherein $R^4$ and X are as defined hereinabove and $R^5$ represents monosubstitution ortho or para on the ring or disubstitution ortho-para with substituents of 3 or more non-hydrogen atoms. Preferred substituents are branched alkyl groups. Other useful substituents include alkyl ethers, aryl ethers, sulfones, amides, sulfonamides and the like. $R^5$ can also represent monosubstitution or disubstitution in the meta position with branched alkyl groups.

In another preferred embodiment of the invention, $R^2$ represents a ballasting group of the formula:

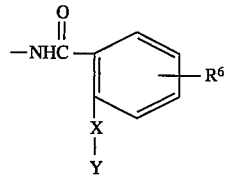

wherein X and Y are as defined hereinabove and $R^6$ is alkyl, aryl, heterocyclic, amidoalkyl, amidoaryl, carboxyalkyl, sulfonamido, sulfo, nitro, and the like. Preferably, $R^6$ represents one or more branched alkyl groups.

As hereinabove described, the ballasting group, which is attached to the 3-position of the 5-pyrazolone ring in the couplers of this invention, has a ClogP value of at least 6. Preferably, the ClogP value is at least 8. The ClogP value, which is also referred to as the sum of the $\pi$ values, is the calculated value for the logarithm of the octanol-water partition coefficient based on an additivity formulation. For details, reference is made to V. N. Viswanadhan, A. K. Ghose, G. R. Revankar and R. Robbins, *J. Chem. Inform. and Comp. Sci.*, 29, 163 (1989).

Compounds with a ClogP of greater than zero are hydrophobic, i.e., they are more soluble in organic media than in aqueous media, whereas compounds with a ClogP of less than zero are hydrophilic. A compound with a ClogP of one is ten times more soluble in organic media than in aqueous media, and a compound with a ClogP of two is one hundred times more soluble in organic media than in aqueous media.

In the present invention, steric interactions close to the coupling site are used to influence coupling rates, leuco dye stability and hue. Coupling rates can be matched in the photographic system in a way to optimize density (tone scale) and to influence grain and sharpness. Leuco dye lifetime is reduced by steric interactions with the ballasting group. By careful design of the ballasting group, a steric group is built into the coupler at a slight distance from the coupling site such that it is able to overlap the coupling site as a result of low energy conformation. Thus the invention provides great flexibility in controlling the rate of coupling without the need to modify the chromophore itself. It also offers synthetic flexibility, soluble couplers and couplers whose hue is not greatly influenced by bulk too close to the coupling site. The couplers can be optimized for coupling rates that effect D-max, curve shape, tone scale, leuco dye formation, grain and coatability in a range of solvents.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, wherein the magenta image-dye-providing material is a two-equivalent 5-pyrazolone magenta-dye-forming coupler as hereinabove described. Typically, the photographic element will also contain a scavenger for oxidized developing agent. Preferably the scavenger is incorporated in an interlayer between silver halide emulsion layers sensitive to different regions of the visible spectrum, although it can be incorporated in an interlayer between silver halide emulsion layers sensitive to the same region of the visible spectrum. The scavenger can be incorporated in layers which also have other functions, such as, for example, antihalation layers or filter layers.

In addition to emulsion layers and interlayers, the elements of the present invention can contain auxiliary layers conventional in photographic elements, such as overcoat layers, spacer layers, filter layers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, Item 308119, Dec., 1989.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 308119, Dec., 1989, and the references listed therein.

The photographic silver halide emulsions utilized in this invention can contain other addenda conventional in the photographic art. Useful addenda are described, for example, in *Research Disclosure*, Item 308119, Dec., 1989. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

The two-equivalent 5-pyrazolone magenta-dye-forming coupler of this invention is typically incorporated in the photographic element with the aid of a suitable coupler solvent. Examples of preferred coupler solvents that can be utilized for this purpose in this invention include:

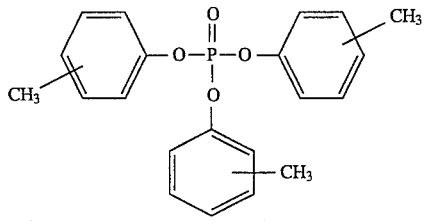

CS-1

(mixture of ortho, meta and para isomers)

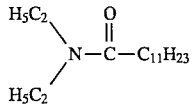

CS-2

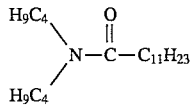

CS-3

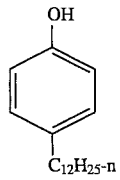

CS-4

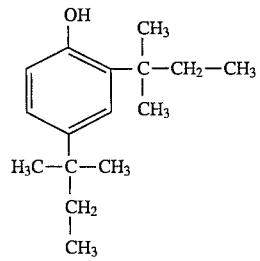

CS-5

$O{=}P(OC_6H_{13}\text{-}n)_3$

CS-6

-continued

CS-7

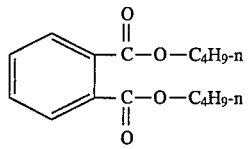

CS-8

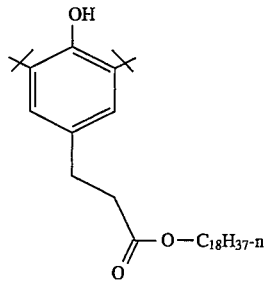

Because of their advantageous characteristics, use of tabular grain silver halide emulsions represents a particularly important embodiment of this invention. Specifically contemplated tabular grain emulsions for use in this invention are those in which greater than 50 percent of the total projected area of the emulsion grains is accounted for by tabular grains having a thickness of less than 0.3 micron and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above, tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

The photographic elements of this invention can be exposed to actinic radiation, typically in the visible region of the spectrum, to form a latent image and can then be processed to form a visible dye image. Color negative photographic elements and color print materials are typically processed in a process which utilizes, in order, the following processing baths: color developer, bleach, fix and stabilizer. In this process, the color developer converts the latent image to metallic silver and forms the dye images, the bleach converts the metallic silver to silver halide, the fix converts the silver halide into soluble silver complexes that are washed from the element and the stabilizing bath improves image dye stability. If desired, the bleaching agent and fixing agent can be combined in a bleach-fixing solution that performs both the functions of bleaching and fixing. Color reversal photographic elements are typically processed in a process which utilizes, in order, the following processing baths: first developer, reversal bath, color developer, bleach, fix and stabilizer. In this process, the first developer reduces the exposed silver halide to metallic silver, the reversal bath nucleates the silver halide that remains after first development, the color developer converts the nucleated silver halide to metallic silver and forms the dye images, the bleach converts the metallic silver to silver halide, the fix converts the silver halide into soluble silver complexes that are washed from the element and the stabilizing bath improves image dye stability. Bleachfixing baths can also be used in place of separate bleach and fix baths in color reversal processing and one or more wash steps are often included in both negative color processing and reversal color processing.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

In the present invention, the hydrophobic, steric and conformational properties of the ballasting group all play key roles in the performance of the coupler. The ClogP values reflect differences in the hydrophobic character of the ballasting group. Activity and hue are dependent in part on the choice of coupler solvent. Increasing the hydrophobicity of the coupler decreases the activity but only to the point where apparent full partitioning into the coupler solvent is achieved. A further decrease in activity requires the incorporation of sterically hindering groups. Increased steric hindrance inhibits the formation of the tetrahedral leuco-dye intermediate and thereby decreases coupler activity. The hydrogenbonded conformation of the couplers of this invention places the ballast in front of the coupling site where it can manifest its ability to sterically hinder the formation of leuco dye.

The invention is further illustrated by the following examples of its practice.

EXAMPLES 1–17

Exemplary two equivalent 5-pyrazolone magenta-dye-forming couplers within the scope of this invention are the couplers of examples 1 to 17 having structural formulas as indicated below.

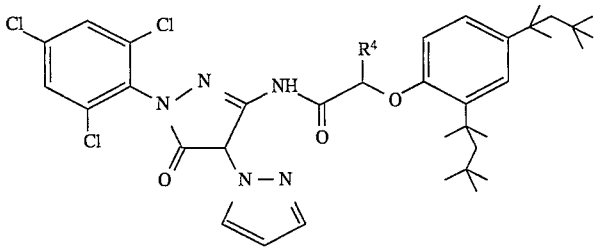
Example 1 $R^4 = C_6H_{13}$
Example 2 $R^4 = C_8H_{17}$
Example 3 $R^4 = C_{12}H_{25}$
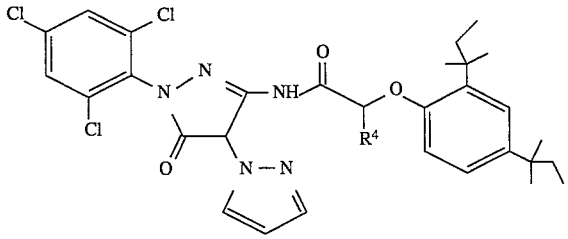
Example 4 $R^4 = C_4H_9$
Example 5 $R^4 = C_6H_{13}$
Example 6 $R^4 = C_8H_{17}$
Example 7 $R^4 = C_{12}H_{25}$
Example 8 $R^4 = C_{16}H_{33}$
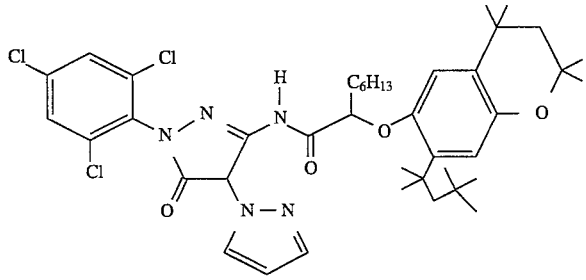
Example 9
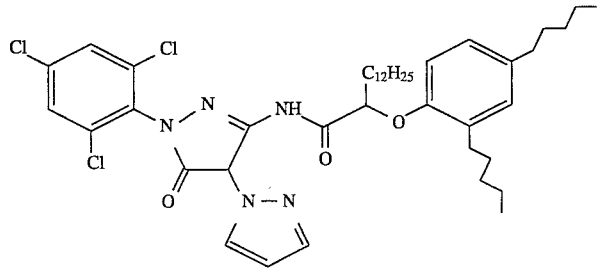
Example 10
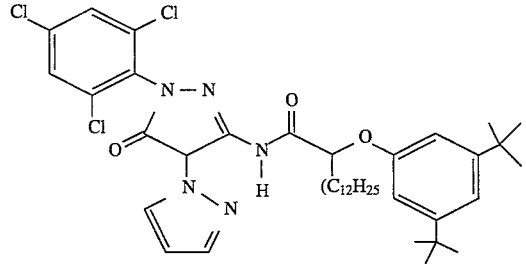
Example 11

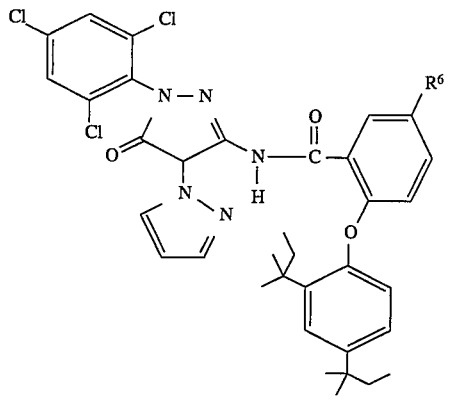

-continued

Example 12 $R^6 = NO_2$

Example 13 $R^6 = NHC(O)C_{11}H_{23}$

Example 14 $R^6 =$

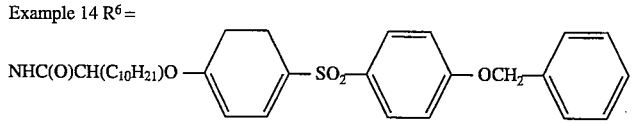

Example 15 $R^6 = NHC(O)CH_2—O$

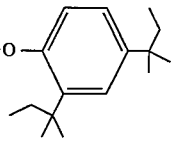

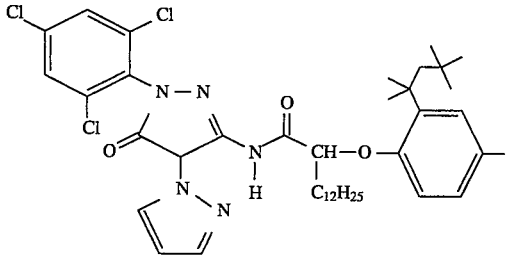

Example 16

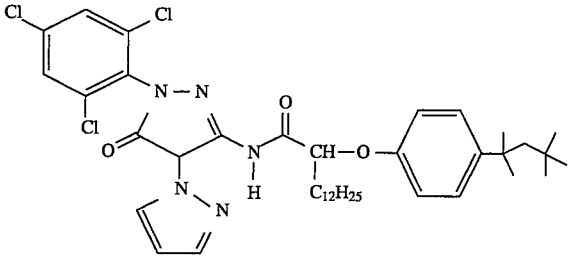

Example 17

The two-equivalent 5-pyrazolone magenta-dye-forming coupler of Example 1 was prepared as described hereinbelow. Synthesis of the other couplers of this invention can be carried out in an analogous manner.

Preparation of ballast acid for Example 1

To a solution of 2,4-di-tert-octyl phenol (7.5g, 0.02 mol) in dry N,N-dimethylformamide (75 mL) was added NaH, 80% dispersion in mineral oil (0.6 g, 0.02 mol). The mixture was stirred for three hours at 25° C. A solution of 2-bromoethyldecanoate (5.9 g, 0.02 mol) in N,N-dimethylformamide (10 mL) was added and the temperature raised to 60° C. for three hours. The reaction mixture was cooled to room temperature and added to water (350 mL). Extraction with 200 mL of ethyl acetate followed by washing with water in amounts sufficient to remove the N,N-dimethylformamide, gave a clear-colored solution that was evaporated to dryness. The carboxylic ester was hydrolyzed by dissolving it in methanol (75 mL), adding 6N NaOH (15 mL) and heating to reflux for 2 hours. The mixture was cooled to room temperature, neutralized with 6N HCl and extracted with ethyl acetate (250 mL). The organic solution was evaporated to give a colorless oil that was suitably pure for further use. Analytical purity could be achieved by column chromatography on silica gel with ligroin eluent to yield 8.8 g product (93% yield).

Preparation of coupler of Example 1

The carboxylic acid ballast described above (7.5 g, 0.016 mol) was dissolved in dichloromethane (30 mL) and oxalyl chloride (4.2 mL, 0,048 mol) was added. The mixture was stirred for 3 hours at 25° C. Excess oxalyl chloride and dichloromethane were distilled off under vacuum. The residue was triturated with toluene (20 mL) which was then distilled off under vacuum. The acid chloride thus formed was taken up in acetonitrile (100 mL) and 1-(2,4,6-trichlorophenyl)-3-amino-4-(1-pyrazolo)-5-pyrazolone (5.62 g, 0.016 mol) in acetonitrile (50 mL) was added. The mixture was heated to vigorous reflux for 24 hours. The acetonitrile was removed via distillation and the residue recrystallized from methanol to yield white needles, 11.6 g, 90% yield of analytically pure product.

To evaluate the performance of couplers 1 to 17, they were coated in a single layer format with a gel overcoat using a fast magenta emulsion. The test coupler was coated at a level of 0.9 mmol/$m^2$ in N,N-di-n-butyl lauramide coupler solvent (1:0.5), 675 mg Ag/$m^2$, 3 g/$m^2$ gel, 1.75 g tetraazaindene/Ag mole. The coatings were processed through a conventional color reversal process with a four minute first developer step and the densities were recorded.

Measured densities were normalized relative to 1-(2,4,6-trichlorophenyl)-3-{3-[2-(2,4-di-tert-pentylphenoxy)ethanamido]benzamido}-5-oxo-2-pyrazoline, a 4-equivalent coupler typically used in current reversal film systems. The couplers of examples 1–17 were coated in half molar quantities with respect to this standard.

The results obtained are summarized in Table 1 below.

TABLE 1

| | Normalized Maximum Density | CLogP for $R^2$ (Sum of π Values) | Es Value for Sterically Hindering Group | π Value for $R^4$ |
|---|---|---|---|---|
| Example 1 | 0.60 | 9.5 | −2.6 | 3.2 |
| Example 2 | 0.54 | 10.3 | −2.6 | 4.3 |
| Example 3 | 0.48 | 11.9 | −2.6 | 6.5 |
| Example 4 | 1.02 | 6.4 | −3.0 | 2.1 |
| Example 5 | 0.78 | 7.2 | −3.0 | 3.2 |
| Example 6 | 0.71 | 8.0 | −3.0 | 4.3 |
| Example 7 | 0.70 | 9.6 | −3.0 | 6.5 |
| Example 8 | 0.70 | 11.2 | −3.0 | 8.6 |
| Example 9 | 0.62 | 7.3 | −2.6 | 4.3 |
| Example 10 | 0.97 | 9.6 | −1.6 | 6.5 |
| Example 11 | 0.90 | 8.5 | −2.8 | 6.5 |
| Example 12 | 0.32 | 6.3 | −3.0 | — |
| Example 13 | 0.34 | 9.5 | −3.0 | — |
| Example 14 | 0.20 | 13.3 | −3.0 | — |
| Example 15 | 0.22 | 11.0 | −3.0 | — |
| Example 16 | 0.82 | 9.2 | −2.6 | 6.5 |
| Example 17 | 0.88 | 8.7 | −2.6 | 6.5 |

A comparison of Examples 4 to 8 in Table 1 demonstrates the importance of hydrophobicity to coupling activity. These Examples represent an increase in ClogP as $R^4$ is increased from n-butyl to n-hexadecyl. Table 1 indicates that the activity decreases as the hydrophobicity increases but only until full partitioning into the oily coupler solvent is achieved (in this series when $R^4$ is $C_8H_{17}$). Further decreases in activity can be obtained by a combination of hydrophobic and steric properties. This is further exemplified by the series comprised of Examples 1, 2 and 3.

A comparison of Examples 7 and 10 demonstrates the effect of the steric hindering group Y. The ClogP values of the two couplers are the same, but the branched tertiary pentyl groups in Example 7 give a decrease in activity compared to Example 10 which has flexible n-pentyl groups in the same position. This is further exemplified by Examples 3 and 8. Both have similar ClogP values but the more sterically bulky tertiary octyl groups of Example 3 result in lower activity compared to the tertiary pentyl groups of Example 8. The decreases in activity obtained in this way are accompanied by improved grain.

As hereinabove described, the present invention allows great flexibility in controlling the rate of coupling without the need to modify the chromophore itself. Steric interactions close to the coupling site are used to influence coupling rate, leuco dye stability and hue. The location and size of the ballast influences ease of synthesis, solubility, coatability, dye hue, dye stability, etc. The invention allows precise tuning of activity by the use of a ballast that locates the steric group out onto the ballast, but that is conformationally designed to bring the steric group to overlap with the coupling site. The invention serves to decrease leuco dye lifetime by the use of steric interactions with the ballast. The ballast is designed to generate soluble couplers that allow ease of coating and choice of coupler solvent. Hydrogen bonding is utilized in the invention to hold the ballast in a desired position.

The invention has been described in detail, with particular reference to certain preferred embodiments thereof, but it should be understood that variations and modifications can be effected within the spirit and scope of the invention.

What is claimed is:

1. A photographic element comprising a support bearing at least one silver halide emulsion layer having associated therewith a two-equivalent 5-pyrazolone magenta-dye-forming coupler; said coupler having a coupling-off group in the 4-position and an activity-modifying ballasting group in the 3-position; said ballasting group:

(1) comprising an —NHCO— radical which is attached via the nitrogen atom thereof to the 3position of the 5-pyrazolone ring;

(2) having a ClogP value of at least 6; and (3) comprising a hydrogen-bonding substituent which (a) forms a five- or six-membered hydrogen-bonded ring with said —NHCO— radical and (b) contains a sterically hindering group with a negative Es value greater than the absolute value of −1.5 wherein said two-equivalent 5 -pyrazolone magenta-dye-forming coupler is represented by the formula:

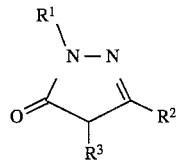

wherein $R^1$ is hydrogen or a monovalent organic radical, $R^3$ is a coupling-off group, and $R^2$ is an activity-modifying ballasting group of the formula:

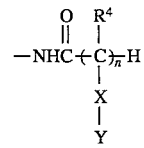

wherein n is 1 or 2

$R^4$ is a monovalent organic group with a π value of at least 2.1,

X is a heteroatom that can hydrogen bond to the hydrogen atom of the —NHCO— radical, and Y is a monovalent organic group which sterically hinders leuco dye formation.

2. A photographic element as claimed in claim 1, wherein X is an oxygen, nitrogen or sulfur atom.

3. A photographic element as claimed in claim 1, wherein $R^4$ is an alkyl group of the formula $C_mH_{2m+1}$ where m is an integer with a value of from 4 to 20.

4. A photographic element as claimed in claim 1, wherein Y is a branched alkyl group or an aryl ring substituted with a branched alkyl group.

5. A photographic element as claimed in claim 1, wherein $R^2$ has a ClogP value of at least 8.

6. A photographic element as claimed in claim 1, wherein Y has a negative Es value greater than the absolute value of −1.5.

7. A photographic element as claimed in claim 1, wherein Y has a negative Es value greater than the absolute value of −2.0.

8. A photographic element as claimed in claim 1, wherein Y is a branched alkyl group.

9. A photographic element as claimed in claim 1, wherein Y is an aryl group substituted with a branched alkyl group.

10. A photographic element as claimed in claim 1, wherein $R^1$ is a chlorine-substituted phenyl group.

11. A photographic element as claimed in claim 1, wherein $R^1$ is a 2,4,6-trichlorophenyl group.

12. A photographic element as claimed in claim 1, wherein $R^3$ is a pyrazolyl group.

13. A photographic element comprising a support bearing at least one silver halide emulsion layer having associated therewith a two-equivalent 5-pyrazolone magenta-dye-forming coupler; said coupler having the formula:

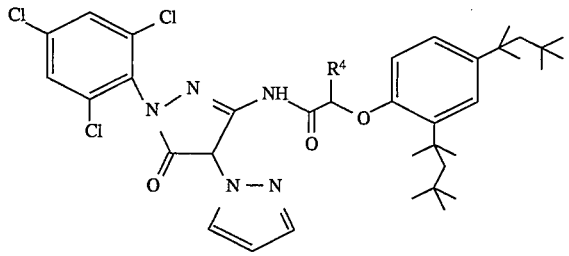

wherein $R^4$ is $—C_6H_{13}$, $—C_8H_{17}$ or $—C_{12}H_{25}$.

14. A photographic element comprising a support bearing at least one silver halide emulsion layer having associated therewith a two-equivalent 5-pyrazolone magenta-dye-forming coupler; said coupler having the formula:

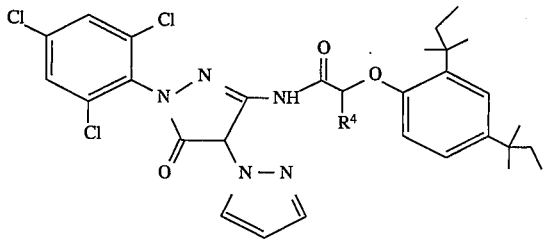

wherein $R^4$ is $—C_4H_9$, $—C_6H_{13}$, $—C_8H_{17}$, $—C_{12}H_{25}$ or $—C_{16}H_{33}$.

15. A photographic element comprising a support bearing at least one silver halide emulsion layer having associated therewith a two-equivalent 5-pyrazolone magenta-dye-forming coupler; said coupler having the formula:

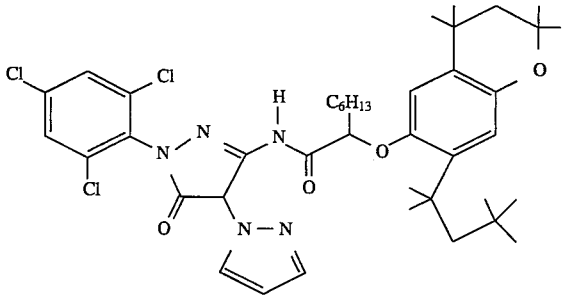

16. A photographic element comprising a support bearing at least one silver halide emulsion layer having associated therewith a two-equivalent 5-pyrazolone magenta-dye-forming coupler; said coupler having the formula:

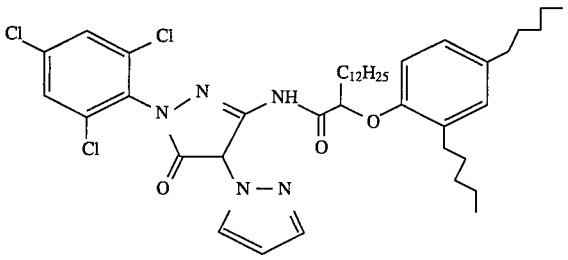

17. A photographic element comprising a support bearing at least one silver halide emulsion layer having associated therewith a two-equivalent 5-pyrazolone magenta-dye-forming coupler; said coupler having the formula:

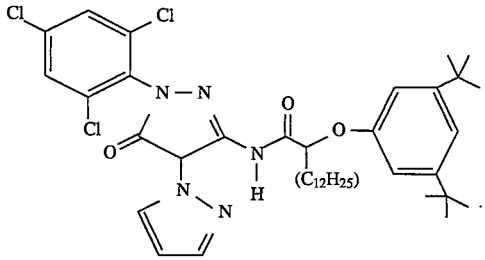

18. A photographic element comprising a support bearing at least one silver halide emulsion layer having associated therewith a two-equivalent 5-pyrazolone magenta-dye-forming coupler; said coupler having the formula:

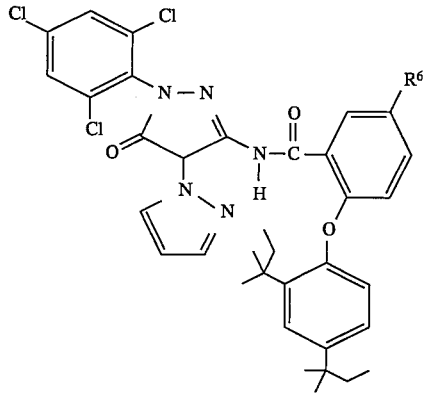

wherein $R_6$ is $—NO_2$

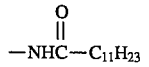

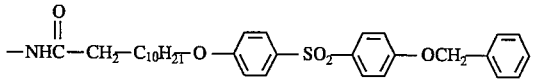

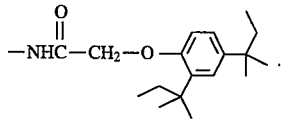

19. A photographic element comprising a support bearing at least one silver halide emulsion layer having associated therewith a two-equivalent 5-pyrazolone magenta-dye-forming coupler; said coupler having the formula:

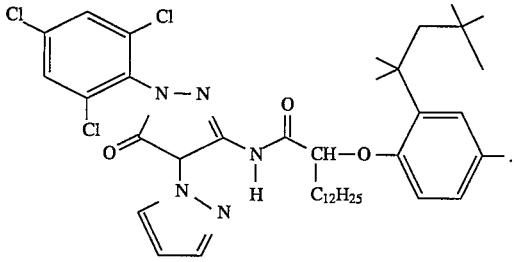

20. A photographic element comprising a support bearing at least one silver halide emulsion layer having associated therewith a two-equivalent 5pyrazolone magenta-dye-forming coupler; said coupler having the formula:

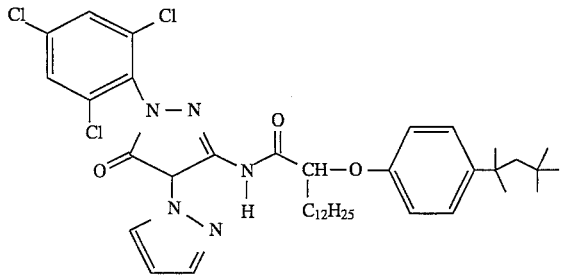

21. A photographic element as claimed in claim 1, wherein $R^2$ represents a ballasting group of the formula:

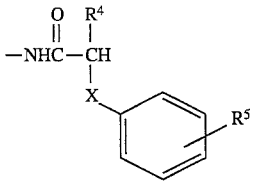

wherein $R^5$ represents disubstitution, in the position meta to the carbon atom bonded to X, with branched alkyl groups and $R^4$ and X are as defined in claim 1.

22. A photographic element as claimed in claim 1, wherein $R^2$ represents a ballasting group of the formula:

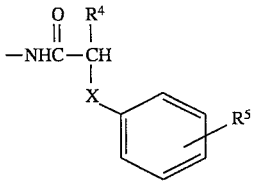

wherein $R^5$ represents disubstitution, in the positions ortho-para to the carbon atom bonded to X, with branched alkyl groups and $R^4$ and X are as defined in claim 1.

* * * * *